United States Patent [19]

Kostorz

[11] Patent Number: 4,989,278

[45] Date of Patent: Feb. 5, 1991

[54] WALL-MOUNT FAUCET WITH ACCESSORY-HOLDING BRACKET

[75] Inventor: Jan R. Kostorz, Menden, Fed. Rep. of Germany

[73] Assignee: Friedrich Grohe Armaturenfabrik GmbH & Co., Humer, Fed. Rep. of Germany

[21] Appl. No.: 487,429

[22] Filed: Mar. 1, 1990

[30] Foreign Application Priority Data

Mar. 9, 1989 [DE] Fed. Rep. of Germany ..... 3907587

[51] Int. Cl.[5] ..... A47K 4/00

[52] U.S. Cl. ..... 4/570; 4/601; 4/654; 4/192; 137/359; 285/46

[58] Field of Search ..... 4/191, 192, 567, 570, 4/601, 628, 638, 654, 656, 658, 615; 137/359, 360; 285/46, 193, 414, 415; 239/282, 283; 248/212, 213

[56] References Cited

U.S. PATENT DOCUMENTS

| | | | |
|---|---|---|---|
| Re. 27,655 | 6/1973 | Mongerson et al. | 4/191 |
| 1,019,766 | 3/1912 | Cronk | 285/46 X |
| 1,227,046 | 5/1917 | Ferguson | 248/212 |
| 1,550,383 | 8/1925 | Morthland | 248/212 |
| 1,572,412 | 2/1926 | Vallier | 4/192 X |
| 1,655,799 | 1/1928 | Rickersberg | 248/212 |
| 3,439,701 | 4/1969 | Stella | 137/359 X |
| 3,448,755 | 6/1969 | Symmons | 137/359 X |
| 4,366,866 | 1/1983 | Sweeney | 285/46 X |
| 4,490,954 | 1/1985 | Cresti | 285/46 X |
| 4,846,207 | 7/1989 | Humpert et al. | 4/192 X |

FOREIGN PATENT DOCUMENTS

| | | | |
|---|---|---|---|
| 2412679 | 3/1974 | Fed. Rep. of Germany | 137/359 |
| 3723828 | 1/1989 | Fed. Rep. of Germany . | |
| 952093 | 3/1964 | United Kingdom | 4/192 |

*Primary Examiner*—Henry J. Recla
*Assistant Examiner*—Robert M. Fetsuga
*Attorney, Agent, or Firm*—Herbert Dubno; Andrew Wilford

[57] ABSTRACT

A wall-mount faucet assembly has a mounting fitting adapted to be fixed in the wall and connected to incoming hot- and cold-water lines. This fitting is formed with an outwardly directed seat provided with hot- and cold-water ports to which can be fastened an end of a substantially cylindrical body centered on an axis of a mixing faucet. An annular holder has two parts that engage complementarily around the faucet body adjacent the base and against the wall and that can be secured together to clamp the holder to the faucet body. An annular cover plate engageable around the faucet body and over the holder axially with the wall is fastened to this holder to lock it in place. The cover plate includes a main part formed with a radially open slot wide enough to fit over the faucet body, and a filler part complementarily engageable in the slot.

12 Claims, 2 Drawing Sheets

WALL-MOUNT FAUCET WITH ACCESSORY-HOLDING BRACKET

FIELD OF THE INVENTION

The present invention relates to a wall-mount faucet. More particularly this invention concerns such a faucet which is provided with an accessory bracket for holding a hand-held shower or the like.

BACKGROUND OF THE INVENTION

A standard wall-mount faucet assembly comprises a mounting fitting adapted to be fixed in the wall and connected to incoming hot- and cold-water lines and a faucet that is bolted to this assembly. The mounting fitting is typically installed when the plumbing is roughed in and is usually provided with a shield to protect it as the wall is completed.

To cover the hole in the wall around the mounting fitting the assembly includes a cover plate which as described in U.S. Pat. No. 4,846,207, is a one-piece annular disk that is fitted around the faucet body. This disk can slide along the faucet and is pulled forward to install the faucet on the mounting plate, then is pushed back against the wall to cover the hole and seal around the fitting.

Such a cover plate is a substantial hindrance to the worker installing the faucet. In addition if the faucet is not perfectly perpendicular to the wall, the plate will not seal well.

OBJECTS OF THE INVENTION

It is therefore an object of the present invention to provide an improved wall-mount faucet assembly.

Another object is the provision of such an improved wall-mount faucet assembly which overcomes the above-given disadvantages, that is which is easy to assemble and seal even if the faucet is not perpendicular to the wall.

SUMMARY OF THE INVENTION

A wall-mount faucet assembly according to this invention has a mounting fitting adapted to be fixed in the wall and connected to incoming hot- and cold-water lines. This fitting is formed with an outwardly directed seat provided with hot- and cold-water ports to which can be fastened an end of a substantially cylindrical body centered on an axis of a mixing faucet. An annular holder has two parts that engage complementarily around the faucet body adjacent the base and against the wall and that can be secured together to clamp the holder to the faucet body. An annular cover plate engageable around the faucet body and over the holder axially with the wall is fastened to this holder to lock it in place.

According to another feature of this invention the cover plate includes a main part formed with a radially open slot wide enough to fit over the faucet body, and a filler part complementarily engageable in the slot. Thus the entire cover plate need only be installed after the faucet itself is in place, so that it poses no hindrance to the installer.

The parts of the holder have to one radial side of the faucet body ends that hinge together and are provided to the other radial side of the faucet body with a transverse screw. To this end the holder parts are formed to the one side with hinge-like interfitting hooks.

In accordance with another feature of this invention the cover plate includes an annular inner ring snugly engaged around the faucet body and having an outwardly convex outer surface and an annular outer ring snugly engaged around the inner ring and having an inner surface complementarily engageable with and slidable on the outer surface of the inner ring. The means for securing the cover plate to the holder includes at least one screw engaged through the cover plate and threaded in the holder and the holder has an end projecting radially past the cover plate and formed with a hand-shower holding bracket.

The cover plate according to the invention is provided with a soft annular seal engaged between it and the wall around the fitting. In addition it is formed of two interfitting parts made of a synthetic-resin and capable of being snap-fitted together and the cover-plate parts having interengaging snap formations that fit together when the parts are interengaged around the faucet. The cover plate can slide along the faucet body, whereby different wall thicknesses can be accommodated and the back of the cover plate is formed with recesses complementary to and fitting over the holder.

DESCRIPTION OF THE DRAWING

The above and other objects, features, and advantages will become more readily apparent from the following, reference being made to the accompanying drawing in which.

SPECIFIC DESCRIPTION

Figure 1:
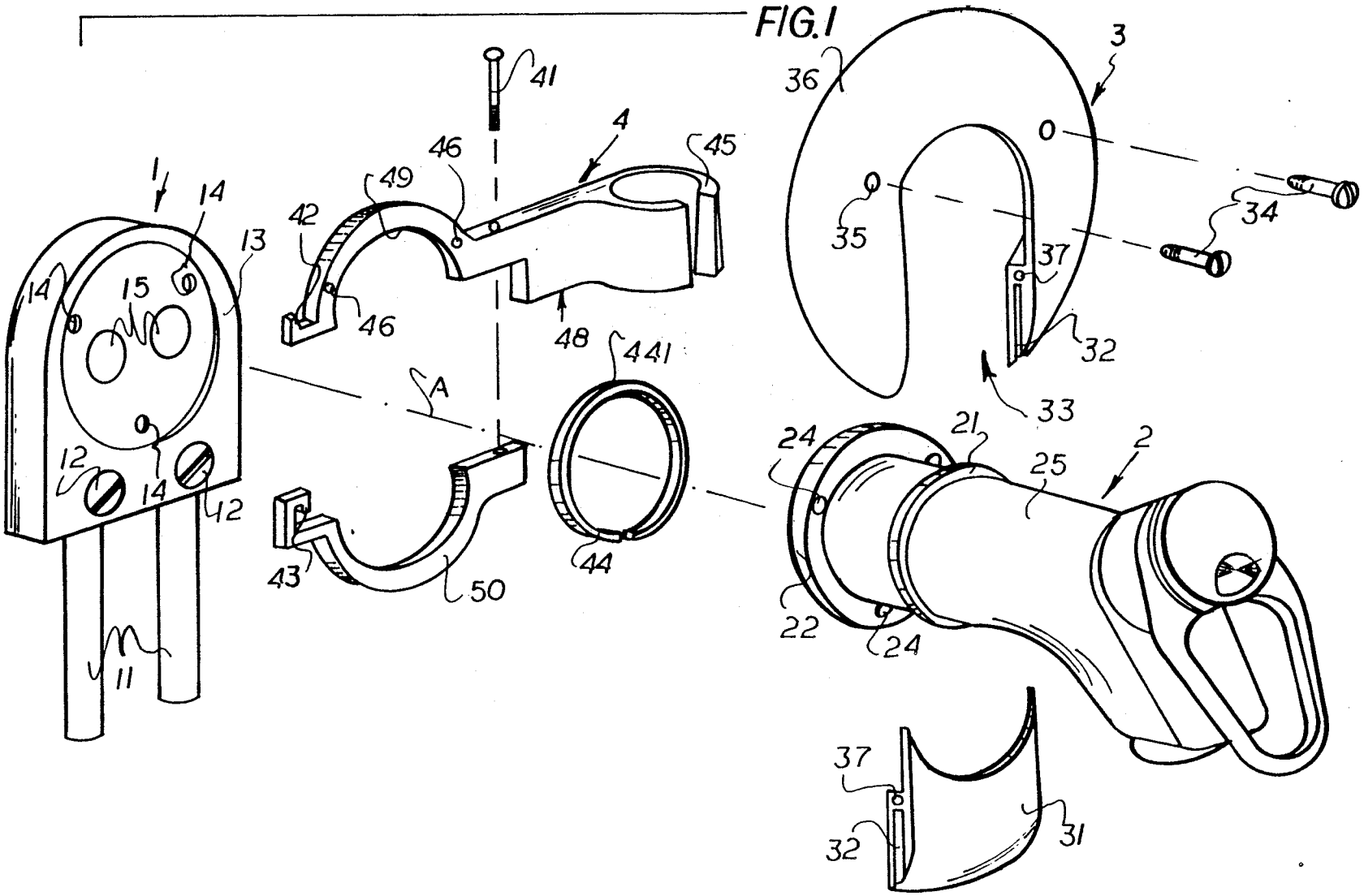
FIG. 1 is an exploded view of the faucet assembly according to this invention.
Figure 2:
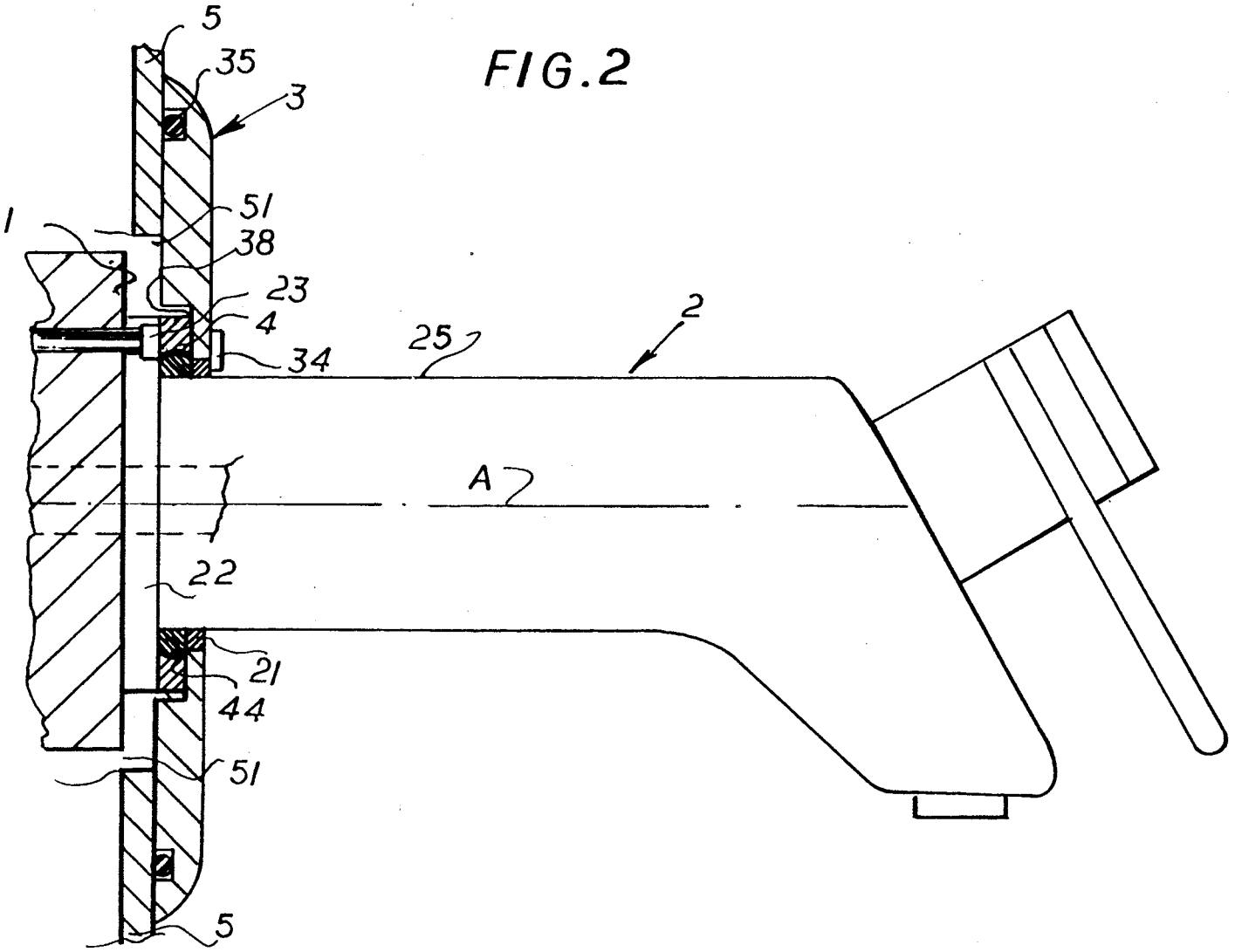
FIG. 2 is an axial section through the assembly.

As seen in FIGS. 1 and 2 a faucet assembly according to this invention basically comprises a wall plate or fitting 1, a faucet 2, a cover plate or escutcheon 3, and a holder bracket 4, all adapted to be mounted in a wall 5.

The wall fitting 1 is adapted to be connected to hot- and cold-water lines 11 and is provided with individual cutoff valves for the incoming hot and cold water. This fitting 1 is fixed in the wall 5 before it is closed and has a vertical front face formed with a cylindrical seat 13 in which three angularly equispaced threaded holes 14 and two water ports 15 open.

The faucet 2 has a disk-like rear end 22 formed with three angularly equispaced unthreaded holes 24 alignable with the holes 14. In addition this faucet 2 has a cylindrical body 25 centered on an axis A and fitted with an annular seal ring 21. As is conventional the faucet 2 includes a mixing valve.

The cover or escutcheon plate 3 comprises a U-shaped main part 36 formed with a radially open notch 33 of a width equal at least to the diameter of the faucet body 25. A filler part 31 is engageable in this slot 33 to fill it perfectly. Interfitting ridge and groove formations 32 on the parts 36 and 31 allow them to slide together and interfitting bumps and recesses 37 hold them together in a snap-fit. In its upper region the part 36 is formed with two axially throughgoing holes 35 adapted to receive screws 34. The plate 3 is wholly made of a durable synthetic resin and engages snugly around the ring 21. The back face of the cover plate 3 is formed with a recess 38 that is complementary to the holder 4 and with a groove receiving a soft seal ring 35.

The holder 4 comprises a main part 48 itself formed with a semicircular half ring 49 itself formed with two threaded holes 46 alignable with the holes 35. To one side the part 49 is formed with an upwardly directed hook 42 and to the other with a shower holder 45. In addition the holder 4 comprises a lower part 50 of semicircular shape having on one side a hook 43 engageable hinge-fashion with the hook 42. A screw 41 can engage through the parts 48 and 50 to secure them together. A split ring 44 engaged around the faucet body 25 has an outwardly convex outer surface 441 and the inner periphery of the holder 4 is complementary thereto. Thus the holder 4 can be fitted very tightly to the ring 44 even when the axis A is not perfectly perpendicular to the wall 5.

In use the fitting 1 is first installed in the wall 5 and normally covered with a shield/template. Then the wall 5 is formed with a hole 51 around the fitting 1 and, once the wall is complete, the unillustrated shield/template is removed.

The faucet 2 is then secured to the fitting 1 by screwing screws 23 through the holes 24 into the holes 14, matching holes on the back of the plate 22 with the ports 15. The valves 12 can then be opened to flush the system.

Then the ring 44 is fitted to the faucet body 25 and the two parts 48 and 50 are fitted around this ring 44 and locked in place thereon by the screw 41. This leaves the holder 4 solidly fixed to the faucet 2 and flat against the wall 5.

Thereafter the seal 21 is slid back against the holder 4 and the plate part 36 is fitted down over the faucet body 25. The screws 34 are inserted through the holes 35 into the holes 46 to lock this part 36 in place, and the filler part 31 is slid into the groove 33.

The resultant assembly presents a very neat appearance. The holder 4 will be flat against the wall and the cover plate 3, whose back face is shaped to fit complementarily over this holder 4, will fit snugly to it and will also fit flat against the wall 5. Since the holder 4 can be locked even in a nonperpendicular position to the faucet 2, the plate 3 will inherently be perfectly flat on the wall 5 so that the seal 35 will ensure a perfectly watertight fit.

I claim:

1. A wall-mount faucet assembly comprising:

a mounting fitting adapted to be fixed in the wall and connected to incoming hot- and cold-water lines, the fitting being formed with an outwardly directed seat provided with hot- and cold-water ports;

a mixing faucet having a substantially cylindrical body centered on an axis and having an end complementarily fittable with the seat;

fastening means for securing the faucet to the fitting with the end fitted tightly in the seat;

a holder having an annular mounting bracket including two parts engageable complementarily around the faucet body adjacent the base and against the wall;

locking means for securing the two bracket parts together and thereby clamping the holder to the faucet body;

an annular cover plate engageable around the faucet body and axially over the bracket and against the wall; and means for securing the cover plate to the bracket.

2. The wall-mount faucet assembly defined in claim 1 wherein the cover plate includes a main part formed with a radially open slot wide enough to fit over the faucet body, and a filler part complementarily engageable in the slot.

3. The wall-mount faucet assembly defined in claim 1 wherein the parts of the bracket have to one radial side of the faucet body ends that hinge together and are provided to the other radial side of the faucet body with a transverse screw constituting the locking means.

4. The wall-mount faucet assembly defined in claim 3 wherein the bracket parts are formed to the one side with hinge-like interfitting hooks.

5. The wall-mount faucet assembly defined in claim 1 wherein the means for securing the cover plate to the bracket includes at least one screw engaged through the cover plate and threaded in the bracket.

6. The wall-mount faucet assembly defined in claim 11 wherein the holder has an end projecting radially past the cover plate and formed with a hand-shower holding bracket.

7. The wall-mount faucet assembly defined in claim 1 wherein the cover plate is provided with a soft annular seal engageable between it and the wall around the fitting.

8. The wall-mount faucet assembly defined in claim 1 wherein the cover plate is formed of two interfitting parts made of a synthetic-resin and capable of being snap-fitted together.

9. The wall-mount faucet assembly defined in claim 8 wherein the cover-plate parts having interengaging snap formations that fit together when the parts are interengaged around the faucet.

10. The wall-mount faucet assembly defined in claim 1 wherein the cover plate can slide along the faucet body, whereby different wall thicknesses can be accommodated.

11. The wall-mount faucet assembly defined in claim 1 wherein the back of the cover plate is formed with recesses complementary to and fitting over the holder.

12. The wall-mount faucet assembly comprising:

a mounting fitting adapted to be fixed in the wall and connected to incoming hot- and cold-water lines, the fitting being formed with an outwardly directed seat provided with hot- and cold-water ports;

a mixing faucet having a substantially cylindrical body centered on an axis and having an end complementarily fittable with the seat;

fastening means for securing the faucet to the fitting with the end fitted tightly in the seat;

a holder having an annular mounting bracket including two parts engageable complementarily around the faucet body adjacent the base and against the wall and provided with a radially projecting arm;

locking means for securing the two bracket parts together and thereby clamping the bracket to the faucet body;

an annular cover plate engageable around the faucet body and axially over the bracket and against the wall, the cover plate including an annular inner ring snugly engaged around the faucet body and having an outwardly convex outer surface, and an annular outer ring snugly engaged around the inner ring and having an inner surface complementarily engageable with and slidable on the outer surface of the inner ring; and means for securing the cover plate to the bracket.

* * * * *